US007883296B2

(12) United States Patent
Meyer

(10) Patent No.: US 7,883,296 B2
(45) Date of Patent: Feb. 8, 2011

(54) SHORING BEAM EXTENSION AND REINFORCEMENT ASSEMBLY

(76) Inventor: John W. Meyer, 9323 Fourth St., Lanham, MD (US) 20706

( * ) Notice: Subject to any disclaimer, the term of this patent is extended or adjusted under 35 U.S.C. 154(b) by 355 days.

(21) Appl. No.: 12/230,371

(22) Filed: Aug. 28, 2008

(65) Prior Publication Data

US 2010/0054869 A1 Mar. 4, 2010

(51) Int. Cl.
*E02D 17/06* (2006.01)

(52) U.S. Cl. ..... 405/283; 405/279; 256/67

(58) Field of Classification Search ..... 405/279, 405/282–283; 256/67
See application file for complete search history.

(56) References Cited

U.S. PATENT DOCUMENTS

| | | | |
|---|---|---|---|
| 1,225,431 | A | 5/1917 | Gelbart |
| 2,690,326 | A | 9/1954 | Kranick |
| 2,888,818 | A | 6/1959 | Leuthesser |
| 2,956,409 | A | 10/1960 | Wicke |
| 3,159,978 | A | 12/1964 | De Lillo |
| 3,393,521 | A | 7/1968 | Cammisa |
| 3,420,065 | A | 1/1969 | Holl |
| 3,496,727 | A | 2/1970 | De Wesse et al. |
| 3,584,465 | A | 6/1971 | Holl |
| 3,710,578 | A | 1/1973 | Inoue |
| 3,750,409 | A | 8/1973 | Orfei |
| 3,992,887 | A | 11/1976 | Fisher |
| 4,154,062 | A | 5/1979 | Koehl |
| 4,208,038 | A | 6/1980 | Reid |
| 4,398,840 | A | 8/1983 | French |
| 4,453,863 | A | 6/1984 | Sutton et al. |
| 4,569,451 | A | 2/1986 | Parrott et al. |
| 4,682,914 | A | 7/1987 | Aihara et al. |
| 4,685,837 | A | 8/1987 | Cicanese |
| 4,850,747 | A | 7/1989 | Morelli |
| 4,993,880 | A | 2/1991 | Collins |
| 5,073,066 | A | 12/1991 | Richland |
| 5,154,541 | A | 10/1992 | Boren et al. |
| 5,214,899 | A | 6/1993 | Beeche et al. |
| 5,232,313 | A | 8/1993 | Jennings et al. |
| 5,234,188 | A | 8/1993 | McSwain |
| 5,593,143 | A | 1/1997 | Ferrarin |
| 5,683,074 | A | 11/1997 | Purvis et al. |
| 5,690,446 | A | 11/1997 | Poissant et al. |

(Continued)

FOREIGN PATENT DOCUMENTS

| | | |
|---|---|---|
| GB | 2166774 | 5/1986 |

*Primary Examiner*—Tara Mayo-Pinnock
(74) *Attorney, Agent, or Firm*—Diederiks & Whitelaw, PLC

(57) ABSTRACT

A shoring beam extension and reinforcement assembly allows a user to removably connect a plurality of shoring beams together so as to customize a support assembly to a particular excavation site. In use, main shoring beams extending around the periphery of an excavation site are connected at the corners by corner connections and are connected along the longitudinal sides of the excavation site by the extension of reinforcement assembly. Additionally, the first and second connectors support a center shoring beam laterally across the excavation site. The assembly is provided with additional support by tabs extending from each of the first and second connectors. Reinforcing beams include tabs having apertures adapted to align with apertures in the tabs of the first and second connectors such that connecting pins may be inserted there through to connect the reinforcing beams with the connectors. Eyelets located on the first and second connectors provide a means by which the assembly may be supported.

20 Claims, 5 Drawing Sheets

U.S. PATENT DOCUMENTS

| | | | |
|---|---|---|---|
| 5,711,131 | A | 1/1998 | Thomas |
| 5,741,091 | A | 4/1998 | St. George et al. |
| 5,966,890 | A | 10/1999 | Inman |
| 6,267,538 | B1 | 7/2001 | Caldwell |
| 6,416,259 | B1 | 7/2002 | Meyer |
| 6,821,057 | B1 | 11/2004 | Kadiu |
| 6,984,092 | B1 | 1/2006 | Meyer et al. |
| 7,048,471 | B2 | 5/2006 | Kadiu |
| 7,056,068 | B2 | 6/2006 | Kadiu |
| 7,128,500 | B2 | 10/2006 | Meyer |
| 2002/0159844 | A1 | 10/2002 | Meyer |
| 2004/0170478 | A1 | 9/2004 | Kadiu |

SHORING BEAM EXTENSION AND REINFORCEMENT ASSEMBLY

BACKGROUND OF THE INVENTION

1. Field of the Invention

The present invention is generally directed to a system for temporarily shoring up an excavation site. More particularly, the invention is directed to a shoring beam extension and reinforcement assembly for an excavation site shoring system.

2. Description of the Prior Art

In a typical excavation site, workers are exposed to numerous hazards. The most common hazard is having the walls of the excavation site cave in on the workers, thus causing serious injury. Often, due to soil conditions and wetness, the sides of a construction site will simply collapse. Water is a particularly dangerous hazard because it is so heavy and can destroy shoring that has not been properly reinforced. Realizing this problem the government, at both the federal and state level, has set up specific requirements for all excavation sites to avoid the problem of cave-ins. For example, the United States Department of Labor and, more specifically, the Occupational Safety and Health Administration (OSHA), requires that excavation sites be prepared with some type of shoring. Additionally, many companies are now aware of the problems involved in a typical excavation site and have developed internal policies requiring shoring for any excavations they contract to have completed.

A good example of a typical excavation project is found in replacing underground storage tanks for a gasoline station. In such an operation, sheet piling is pounded into the ground in a generally rectangular configuration around the work site. The piling has to be driven extremely deeply into the ground and arranged to provide sufficient support against potential cave-ins. Typically, the sheet piling has to be driven so deep that half its total height remains underground after the excavation has been completed. Use of such large amounts of material is quite expensive. After the sheet piling has been installed, the workmen then remove the dirt and fill material from within the rectangular shoring. During the work of removing the old storage tanks and replacing them with new storage tanks, the shoring provides protection to the workmen against potential cave-ins. Once the storage tank replacement operation has been completed, the shoring can either be completely removed or simply cut down to a safe distance below ground and then left in place. Such a method of shoring an excavation site is extremely expensive.

One solution to the problem is set forth in U.S. Pat. No. 6,984,092, which is incorporated herein by reference and discloses a corner connection for temporary shoring providing a connector for interconnecting various beams used to reinforce shoring. Referring now to FIG. 1, there is shown a typical excavation site 205 incorporating a temporary shoring system as set forth in U.S. Pat. No. 6,984,092. Excavation site 205 includes an excavation hole 206 incorporating corner connections 211-214 for temporary shoring 218. Temporary shoring 218 comprises three major elements: interlocking sheet piling 219, I-beams (wales) or shoring beams 220-223 and corner connections 211-214, each connection including two connectors for the I-beams 220-223. Interlocking sheet piling 219 is placed along the walls of the excavation hole 206. Typically, a driving machine 225 is used to drive each section of piling 219 to a desired depth within the ground.

A reinforcing structure 226 is provided behind the interlocking sheet piling 219. The reinforcing structure 226 includes the set of I-beams 220-223 that interact with the set of corner connections 211-214. Additionally, a reinforcing assembly is provided, which includes a reinforcing bar 320, a first spacer bar 322 attached to the reinforcing bar 320 and first shoring beam connector 229, and a second spacer bar 324 attached to the reinforcing bar 320 and second shoring beam connector 230.

The system of the '092 patent utilizes connecting members to secure I-beams together at the corners of an excavation site. With this arrangement, the sheet piling does not need to be driven so deep as before. As a result, less sheet piling is used and the sheet piling is cheaper to install. Although an improvement over prior shoring arrangements, the shoring system of the '092 patent is not easily adapted to different size excavations because each side of the arrangement is the length of one I-beam. Therefore, there exists a need in the art for an inexpensive shoring system that can easily be expanded and used on a larger scale.

The following invention addresses the problem of large excavation sites by provided an improved temporary shoring arrangement including a removable shoring beam extension and reinforcement assembly.

SUMMARY OF THE INVENTION

A shoring beam extension and reinforcement assembly is provided that allows a user to removably connect a plurality of shoring beams together so as to customize a support assembly to a particular excavation site. The reinforcement assembly generally comprises a center shoring beam and first and second connectors. Each of the first and second connectors is comprised of first, second and third hollow box portions, and each hollow box portion is adapted to receive an end portion of a shoring beam. In use, main shoring beams extending around the periphery of an excavation site are connected at the corners by corner connections and are connected within the excavation site, along the longitudinal sides thereof, by the extension and reinforcement assembly. Additionally, the first and second connectors support the center shoring beam laterally across the excavation site. The assembly is provided with additional support by tabs extending from each of the first and second connectors. An optional support assembly is provided that includes reinforcing beams with tabs and spacer bars for connecting the tabs on the reinforcing beams with the tabs extending from the first and second connectors. The spacer bars, the reinforcing beams and the connectors are all connected with tab/pin connections. In use, each of the first and second connectors are preferably connected with two reinforcing beams, one on each longitudinal side of the center shoring beam, to provide additional support to the reinforcement assembly. Eyelets located on the first and second connectors provide a means by which the assembly may be supported within the excavation site.

Advantageously, the present invention allows a user to customize a shoring beam system by utilizing pre-cut shoring beams, along with the appropriate number of extension and reinforcement assemblies necessary for a particular excavation site. Additional objects, features and advantages of the present invention will more readily be apparent from the following description of the preferred embodiment thereof, when taken in connection with the drawings wherein like reference numerals refer to corresponding parts in the several views.

DETAILED DESCRIPTION OF THE PREFERRED EMBODIMENTS

Figure 2:
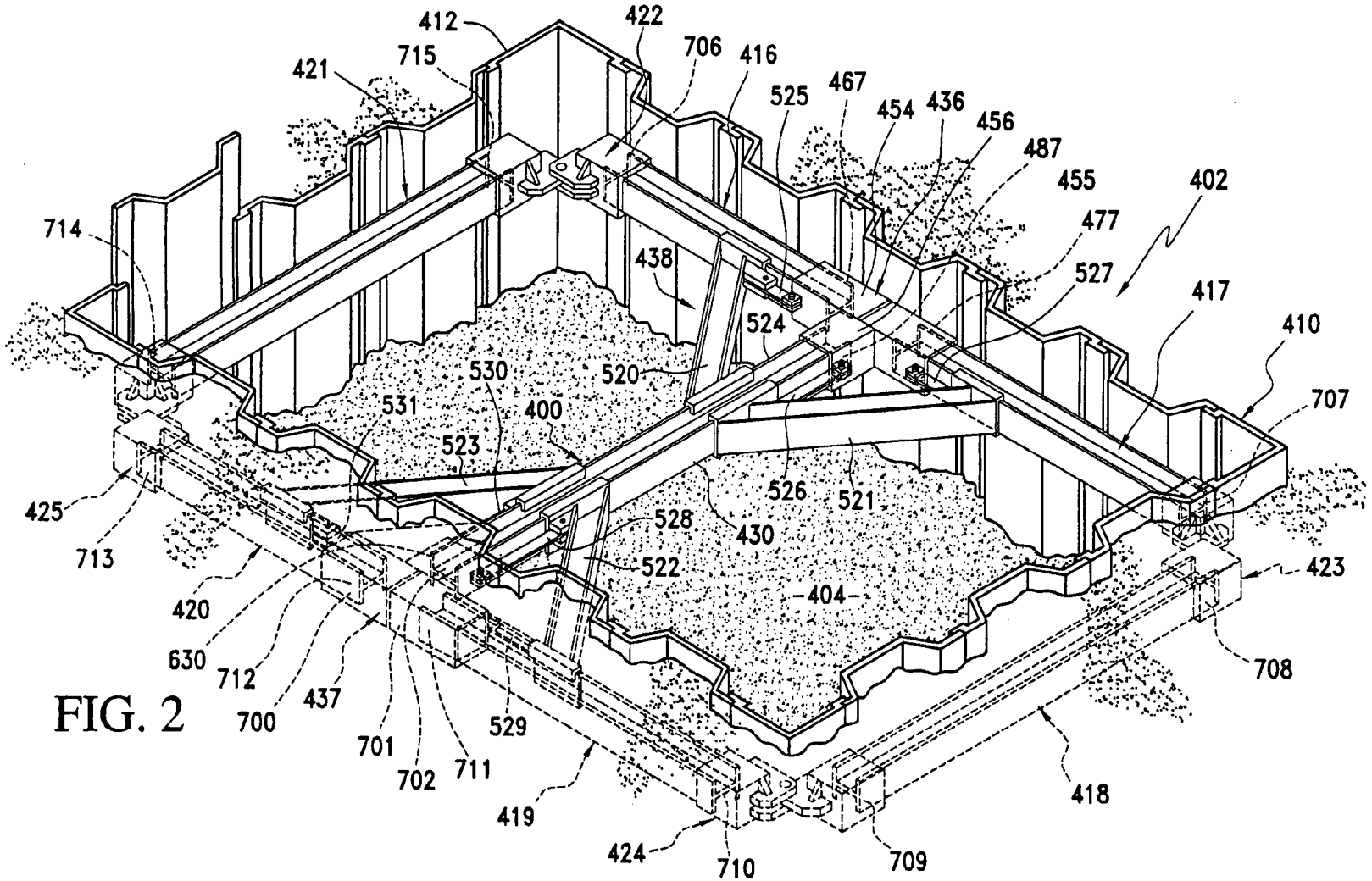
FIG. 2 is a perspective view of a shoring beam extension and reinforcement assembly of the present invention.

Referencing FIG. 2, a shoring beam extension and reinforcement assembly 400 of the present invention will now be discussed. An excavation site 402 having a hole 404 includes a temporary shoring arrangement 410 comprising: interlocking sheet piling 412, main shoring beams 416-421 and corner connections 422-425. Assembly 400 spans hole 404 and cooperates with main shoring beams 416-420 to provide additional support to shoring arrangement 410. In general, assembly 400 comprises a center shoring beam 430 and first and second connectors 436 and 437. An optional support assembly 438 may be utilized for added stability, which will be discussed in more detail below.

Figure 3:
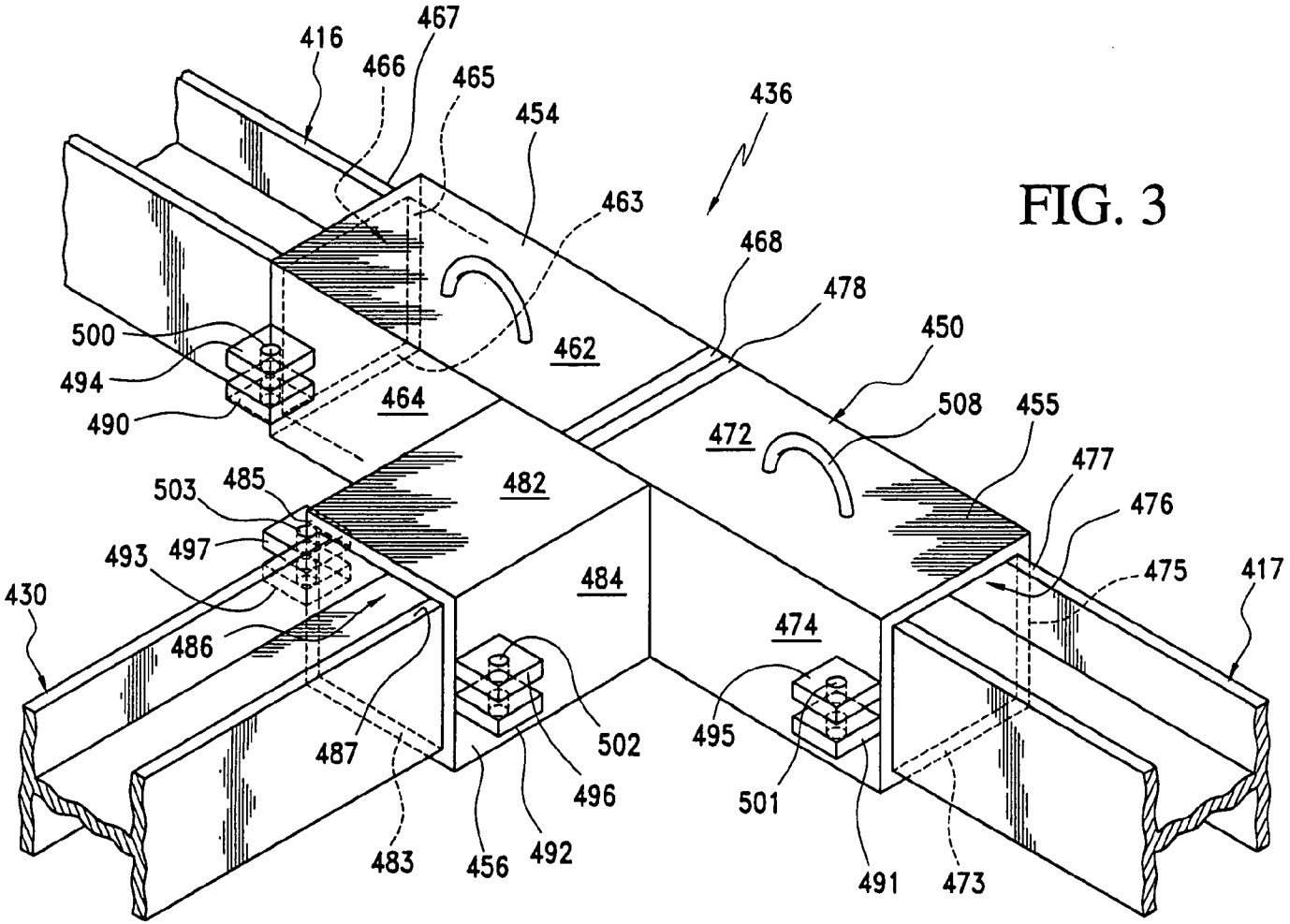
FIG. 3 is a partial perspective view of the shoring beam extension and reinforcement assembly of FIG. 2, showing one end of the assembly.
Figure 4:
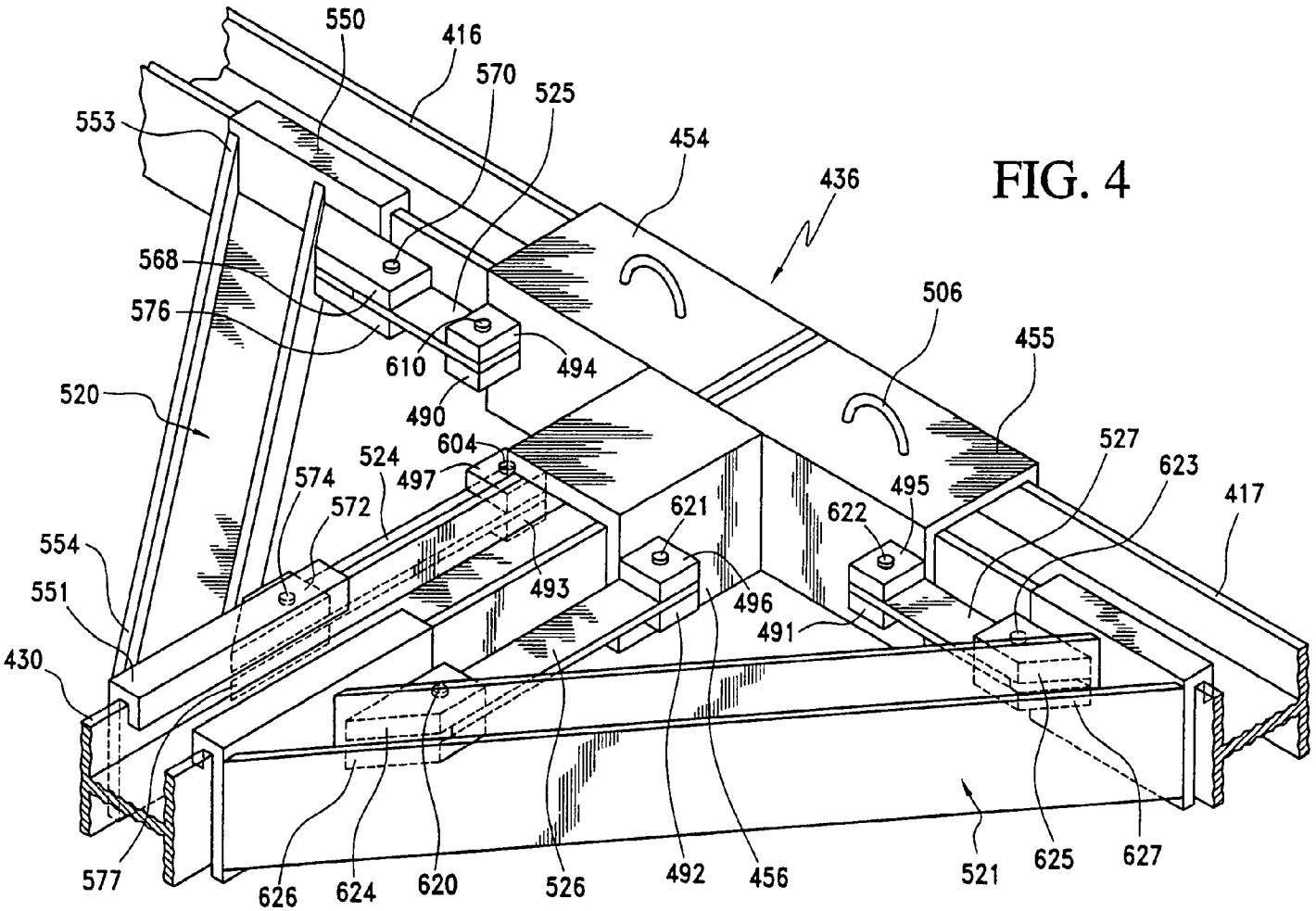
FIG. 4 is a perspective view of the shoring beam extension and reinforcement assembly of FIG. 3 with the addition of reinforcing beams.

With reference to FIGS. 3 and 4, the details of first connector 436 will now be discussed. First connector 436 includes a longitudinally extending main body portion 450 extending along a first longitudinal axis comprising a first hollow box portion 454 and a second hollow box portion 455. Additionally, first connector 436 includes a third hollow box portion 456 extending along a second longitudinal axis laterally from main body portion 450. First, second and third box portions 454-456 each comprise four panels to form an open box shape. With respect to first box portion 454, opposing top and bottom panels 462, 463 are connected with opposing side panels 464, 465 to form the square or rectangular opening 466 designed to receive an end 467 of main shoring beam 416. Optionally, an end panel 468 closes off one end of first box portion 454. Likewise, with respect to second box portion 455, opposing top and bottom panels 472, 473 are connected with opposing side panels 474, 475 to form the square or rectangular opening 476 designed to receive an end 477 of main shoring beam 417. When end panel 468 is present, second box portion 455 may share end panel 468 with first box portion 455, or may have its own end panel 478. Finally, third box portion 456 includes opposing top and bottom panels 482, 483 connected with opposing side panels 484, 485 to form the square or rectangular opening 486 designed to receive an end 487 of center shoring beam 430. Each of panels 462-465, 468, 472-475, 478 and 482-485 are made from heavy steel and are welded together to form the respective box portions 454-456 and box portions 454-456 are welded together to form first connector 436.

First connector 436 additionally comprises numerous pairs of support tabs 490-497. Each of tabs 490-497 is a flat plate-like member that includes a respective aperture 500-507. More specifically, tabs 490, 494 extend from plate 464 of first box portion 454, tab 491, 495 extend from plate 474 of second box portion 455 and tabs 492, 496 and 493, 497 extend from respective plates 484 and 485 of third box portion 456. Tabs 490-497 are preferably made of a similar or the same material as box portions 454-456 and are preferably welded to first connector 436. While other methods may be utilized to attach tabs 490-497 to first connector 436, it is important that each tab be able to withstand the tremendous hydraulic pressures that may be transmitted by shoring system 402 if sheet piling 412 starts to buckle. It should be understood that, while double tabs are shown, first connector 436 may include single tabs extending there from. Additionally, eyelets 508 may be attached to first connector 436 via welding to provide a means for connecting chains or other support structures to connector 436.

Figure 1:
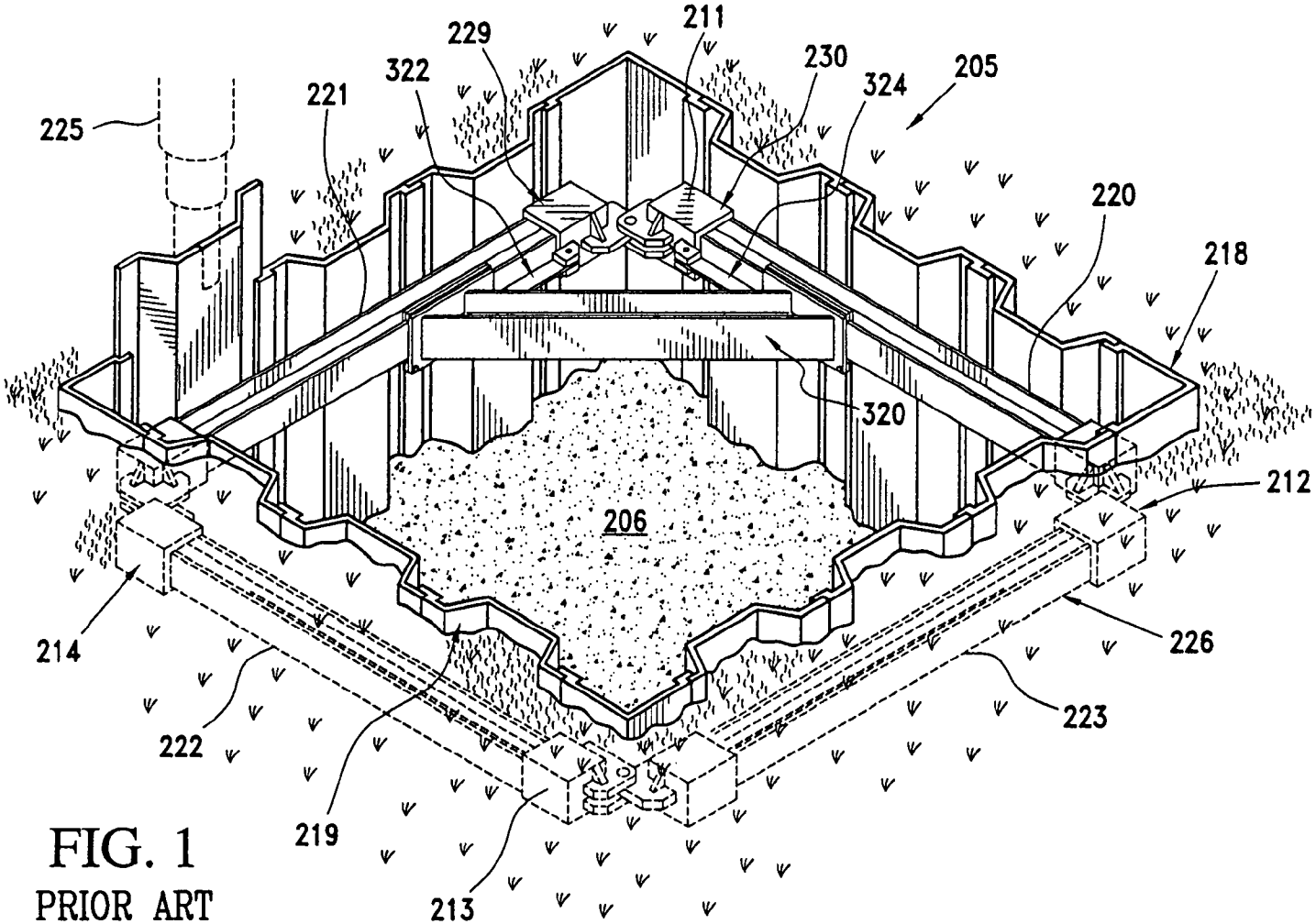
FIG. 1 PRIOR ART
FIG. 1 is a perspective view of a prior art temporary shoring arrangement.

As depicted in FIG. 1, center shoring beam 430 is connected to main shoring beams 416, 417, 419 and 420 via respective first and second connectors 436 and 437. Preferably, first and second connectors 436 and 437 are utilized with support assembly 438. Support assembly 438 includes first, second, third and fourth reinforcing beams 520-523 and spacer bars 524-531. Reinforcing beams 520-523 are each formed of a standard I-beam that has had its ends cut at 45 decrees. Spacer bars 524-531 are simply rectangular flat pieces of steel. Spacer bars must be sized based on the length of reinforcing beams 520-523 and the angle of the shoring beams to be connected.

Figure 5:
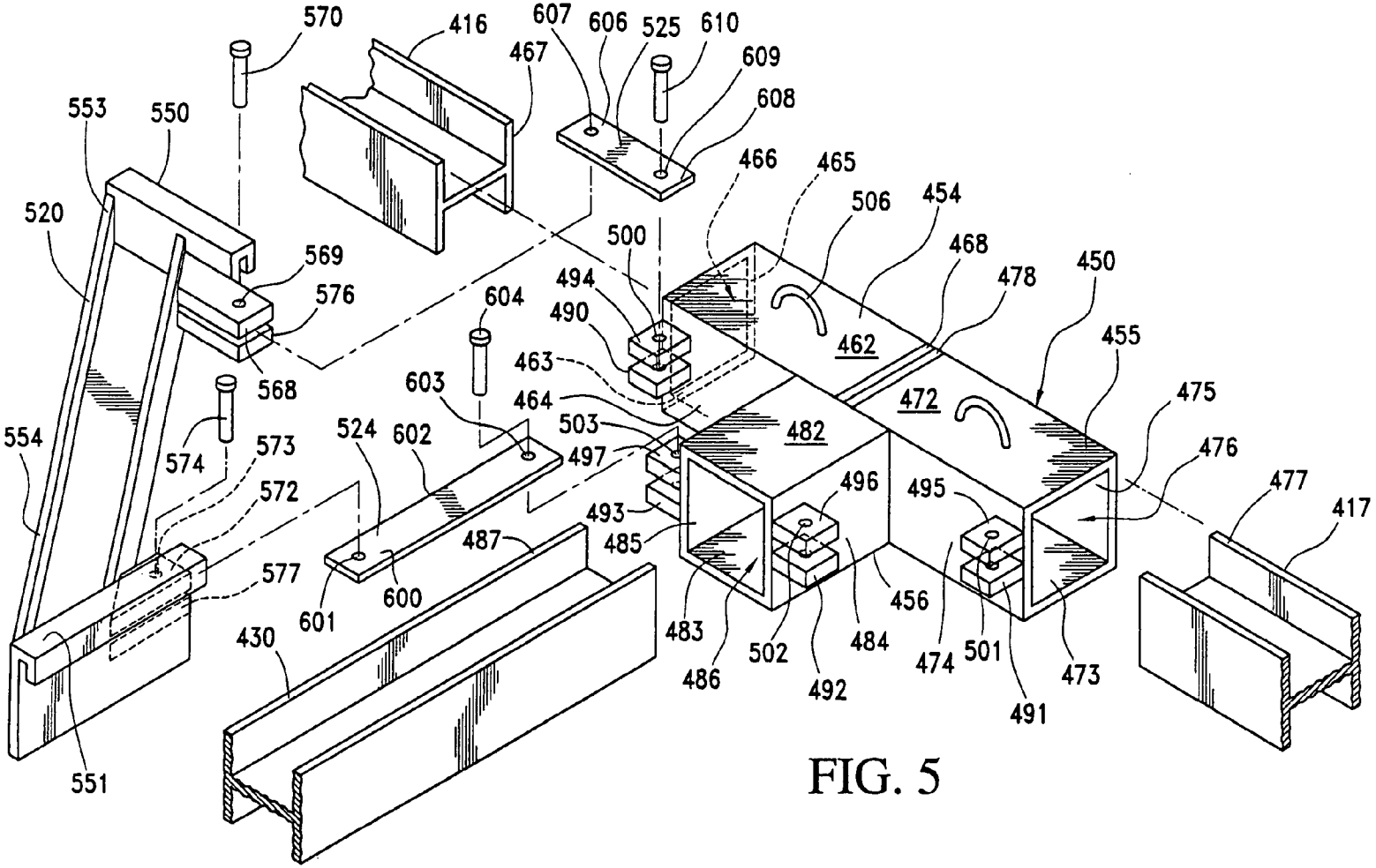
FIG. 5 is a partial exploded view of the assembly shown in FIG. 3.

Turning now to FIGS. 4 and 5, reference will now be made to first reinforcing beam 520 and first and second spacer bars 524 and 525. Reinforcing beam 520 includes a hook 550, 551 attached to each end 553, 554 of reinforcing beam 520. Each hook 550, 551 is adapted to be connected to a shoring beam. More specifically, hook 550 is adapted to connect to the top web of main shoring beam 416 while hook 551 is adapted to connect to the top web of center shoring beam 430. Hooks 550, 551 may be formed from a single piece of metal as shown or from multiple pieces of welded metal. Reinforcing beam 520 further includes at end 553 a first tab 568 having an aperture 569 adapted to receive a first connecting pin 570. Likewise, reinforcing beam 520 includes at end 554 a second tab 572 having an aperture 573 adapted to receive a second connecting pin 574. Optional third and fourth tabs 576 and 577 may be added to reinforcing beam 520 and be aligned with first and second tabs 568 and 572, respectively.

First spacer bar 524 includes an end 600 including an aperture 601 adapted to receive the second connecting pin 574, and a second end 602 including an aperture 603 adapted to receive a third connecting pin 604. Likewise, second spacer bar 525 includes an end 606 including an aperture 607 adapted to receive the first connecting pin 570, and a second end 608 including an aperture 609 adapted to receive a fourth connecting pin 610.

In use, apertures 601 and 602 are aligned with respective apertures 573 and 503; and pin 574 is inserted through apertures 601 and 573, while pin 604 is inserted through apertures 603 and 503. Similarly, apertures 607 and 609 are aligned with respective apertures 569 and 500; with pin 570 being inserted through apertures 607 and 569 and pin 610 being inserted through apertures 609 and 500.

At this point, it should be understood that reinforcing beam 521 attaches to first connector 436 in a manner analogous to the attachment of reinforcing beam 520 to first connector 436. That is, pins 620-623 are inserted through apertures in spacer bars 526 and 527 and apertures in tabs 491, 492 and 624-627 to secure first connector 436 to reinforcing beam 521.

Additionally, it should be understood that, just as one end 487 of center shoring beam 430 is supported by first connector 436, the other end 630 of center shoring beam 430 is supported by second connector 437 in the same manner. With respect to structure, first connector 436 corresponds to second connector 437 and reinforcing beams 520 and 521 correspond to reinforcing beams 522, 523 with various connecting pins utilized to maintain the assembly connected. More specifically, first, second and third hollow box portions 454-456 of first connector 436 correspond to respective first, second, and third hollow box portions 700-703 of second connector 437.

In operation, typically the entire shoring assembly including extension and reinforcement assembly 400 is transported to excavation site 402, generally by a truck. Referencing FIG. 1, main shoring beams 416-421 extending around the periphery of excavation site 402 are connected at the corners by corner connections 422-425 and are connected along the longitudinal sides of excavation 402 site by the extension and reinforcement assembly 400. Additionally, the first and second connectors 436 and 437 support center shoring beam 430 laterally across excavation site 402. More specifically, shoring beams 416-421 are initially arranged in a rectangular or other polygonal shape around the prospective excavation site 402 and center shoring beam 430 is arranged in the center of excavation site 402. Next, corner connections 422-425 and first and second connectors 436 and 437 are placed on the ends of respective shoring beams 416-421, while the ends of center shoring beam 430 are placed in respective first and second connectors 436 and 437.

More specifically, first end 487 of center shoring beam 430 is initially inserted into third hollow box portion 456 of first connector 436, then second end 630 is inserted into third hollow box portion 702 of second corner connection 437. Next, first end 467 of shoring beam 416 is slipped into first box portion 454 of first connector 436 while the opposite end 706 is slipped into corner connection 422; first end 477 of shoring beam 417 is slipped into second box portion 455 of first connector 436 while the opposite end 707 is slipped into corner connection 423; and first end 708 of shoring beam 418 is slipped into corner connection 423 while the opposite end 709 is slipped into corner connection 424. Likewise, a first end 710 of shoring beam 419 is slipped into corner connection 424 while the opposite end 711 is slipped into a second box portion 701 of second connector 437; a first end 712 of shoring beam 419 is slipped into first box portion 700 of second connector 437 while the opposite end 513 is slipped into corner connection 425; and a first end 714 of shoring beam 421 is slipped into corner connection 425 while the opposite end 715 is slipped into corner connection 422.

When reinforcing beams 520-523 are utilized, the tabs of each reinforcing beam 520-523 are interconnected to the tabs of the first and second connectors 436 and 437 via spacer bars 524-531. The sheet piling 412 is then driven into place, and the excavation of site 402 may begin. The assembly 400, as well as the associated main shoring beams 416-421 and corner connectors 422-425, are held at an appropriate height within excavation hole 404 by chains (not shown), as is known in the art. In one embodiment, the chains may extend through eyelets 506 provided on the first and second connectors 436 and 437.

Advantageously, the present invention allows a user to customize a shoring beam assembly without the need for specially cut and welded shoring beams. Instead, a set of shoring beams may be rented, along with the appropriate number of extension and reinforcement assemblies necessary to assembly a shoring system large enough for a particular excavation site.

Although described with respect to preferred embodiments of the invention, it should be understood that various changes and/or modifications could be made to the invention without departing from the spirit thereof. For example, although only single tabs are shown extending from first and second connectors 436 and 437, it should be understood that double tabs may optionally be utilized. Additionally, although only one extension and reinforcement assembly is shown, it should be understood that large excavations sites may benefit from multiple assemblies of the present invention. Therefore, the specific embodiments disclosed herein are to be considered illustrative and not restrictive. Instead, the invention is only intended to be limited by the scope of the following claims.

I claim:

1. A temporary shoring arrangement including upstanding wall portions positioned within an excavation site and braced by a plurality of shoring beams including a first shoring beam having a first end and a second end, and a second shoring beam having a first end and a second end, the temporary shoring arrangement comprising:

a shoring beam extension and reinforcement assembly comprising:

a center shoring beam having a first end and a second end;

a first connector including:

a first hollow box portion formed along a first longitudinal axis and having an opening situated at one longitudinal end of said first hollow box portion wherein said first hollow box portion is adapted to slidably receive, through said opening, the first end of the first shoring beam, and a first tab extending from the first hollow box portion including an aperture therein;

a second hollow box portion formed along the first longitudinal axis and having an opening situated at one longitudinal end of said second hollow box portion, wherein said second hollow box portion is adapted to slidably receive, through said opening, the first end of the second shoring beam, and wherein the second hollow box portion is connected to the first hollow box portion, defining a main body portion of the first connector, and a second tab extending from the second hollow box portion including an aperture therein;

a third hollow box portion formed along a second longitudinal axis and having an opening situated at one longitudinal end of said hollow box portion, the third hollow box portion extending laterally from said main body portion, wherein said third hollow box portion is adapted to slidably receive, through said opening, the first end of the center shoring beam, and third and fourth tabs extending from the third hollow box portion and including respective apertures therein; and a first reinforcing beam adapted to connect to the first shoring beam and the center shoring beam.

2. The temporary shoring arrangement of claim 1, further comprising:

a second reinforcing beam adapted to connect to the second shoring beam and the center shoring beam.

3. The temporary shoring arrangement of claim 2, wherein the second reinforcing beam is further adapted to connect to the first connector via at least one spacer bar.

4. The temporary shoring arrangement of claim 1, further comprising:

a first eyelet extending from the first connector.

5. The temporary shoring arrangement of claim 1, further comprising:

a third shoring beam having a first end and a second end; and a fourth shoring beam having a first end and a second end;

and wherein the shoring beam extension and reinforcement assembly further comprises a second connector including:

a first hollow box portion formed along substantially the same first longitudinal axis and having an opening situated at one longitudinal end of said hollow box portion wherein said hollow box portion is adapted to slidably receive, through said opening, the first end of the third shoring beam;

a second hollow box portion formed along substantially the same first longitudinal axis and having an opening situated at one longitudinal end of said hollow box portion, wherein said second hollow box portion is adapted to slidably receive, through said opening, the first end of the fourth shoring beam, and wherein the second hollow box portion is connected to the first hollow box portion, defining a main body portion of the second connector; and a third hollow box portion formed along substantially the same second longitudinal axis and having an opening situated at one longitudinal end of said hollow box portion, the third hollow box portion extending laterally from said main body portion, wherein said hollow box portion is adapted to slidably receive, through said opening, the second end of the center shoring beam.

6. The temporary shoring arrangement of claim 5, further comprising:

a fifth tab extending from the first hollow box portion of the second connector including an aperture therein;

a sixth tab extending from the second hollow box portion of the second connector including an aperture therein;

seventh and eighth tabs extending from the third hollow box portion of the second connector and including respective apertures therein; and a third reinforcing beam adapted to connect to the third shoring beam and the center shoring beam.

7. The temporary shoring arrangement of claim 6, further comprising:

a fourth reinforcing beam adapted to connect to the fourth shoring beam and the center shoring beam.

8. A shoring beam extension and reinforcement assembly, for use with a shoring arrangement including a first shoring beam having a first end and a second end, and a second shoring beam having a first end and a second end, the assembly comprising:

a center shoring beam including a first end and a second end;

a first hollow box portion formed along a first longitudinal axis and having an opening situated at one longitudinal end of said first hollow box portion wherein said first hollow box portion is adapted to slidably receive, through said opening, the first end of the first shoring beam, and a first tab extending from the first hollow box portion including an aperture therein;

a second hollow box portion formed along the first longitudinal axis and having an opening situated at one longitudinal end of said second hollow box portion, wherein said second hollow box portion is adapted to slidably receive, through said opening, the first end of the second shoring beam, and wherein the second hollow box portion is connected to the first hollow box portion, defining a main body portion of the first connector, and a second tab extending from the second hollow box portion including an aperture therein;

a third hollow box portion formed along a second longitudinal axis and having an opening situated at one longitudinal end of said hollow box portion, the third hollow box portion extending laterally from said main body portion, wherein said third hollow box portion is adapted to slidably receive, through said opening, the first end of the center shoring beam, and third and fourth tabs extending from the third hollow box portion and including respective apertures therein; and a first reinforcing beam adapted to connect to the first shoring beam and the center shoring beam.

9. The shoring beam extension and reinforcement assembly of claim 8, wherein the first reinforcing beam is further adapted to connect to the first connector via at least one spacer bar.

10. The shoring beam extension and reinforcement assembly of claim 8, wherein the first reinforcing beam includes a first hook for engaging the first shoring beam and a second hook for engaging the center shoring beam.

11. The shoring beam extension and reinforcement assembly of claim 8, further comprising:

a second reinforcing beam adapted to connect to the second shoring beam and the center shoring beam.

12. The shoring beam extension and reinforcement assembly of claim 11, wherein the second reinforcing beam is further adapted to connect to the first connector via at least one spacer bar.

13. The shoring beam extension and reinforcement assembly of claim 11, wherein the second reinforcing beam includes a first hook for engaging the second shoring beam and a second hook for engaging the center shoring beam.

14. The shoring beam extension and reinforcement assembly of claim 8, further comprising:

a first eyelet extending from the first connector.

15. The temporary shoring arrangement of claim 8, further comprising:

a second connector including:

a first hollow box portion formed along substantially the same first longitudinal axis and having an opening situated at one longitudinal end of said first hollow box portion wherein said first hollow box portion is adapted to slidably receive, through said opening, a first end of a third shoring beam;

a second hollow box portion formed along substantially the same first longitudinal axis and having an opening situated at one longitudinal end of said second hollow box portion, wherein said second hollow box portion is adapted to slidably receive, through said opening, a first end of a fourth shoring beam, and wherein the first hollow box portion is connected to the second hollow box portion, defining a main body portion of the connecting assembly;

a third hollow box portion formed along substantially the same second longitudinal axis and having an opening situated at one longitudinal end of said third hollow box portion, the third hollow box portion extending laterally from said main body portion, wherein said hollow box portion is adapted to slidably receive, through said opening, the second end of the center shoring beam; and a third reinforcing beam adapted to connect to the third shoring beam and the center shoring beam.

16. The temporary shoring arrangement of claim 15, further comprising:

a fifth tab extending from the first hollow box portion of the second connector including an aperture therein;

a sixth tab extending from the second hollow box portion of the second connector including an aperture therein; and seventh and eighth tabs extending from the third hollow box portion of the second connector and including respective apertures therein.

17. The shoring beam extension and reinforcement assembly of claim 15, wherein the third reinforcing beam is further adapted to connect to the second connector via at least one spacer bar.

18. The shoring beam extension and reinforcement assembly of claim 15, wherein the third reinforcing beam includes a first hook for engaging the third shoring beam and a second hook for engaging the center shoring beam.

19. The shoring beam extension and reinforcement assembly of claim 15, further comprising:

a fourth reinforcing beam adapted to connect to the fourth shoring beam and the center shoring beam.

20. The shoring beam extension and reinforcement assembly of claim 19, wherein the fourth reinforcing beam includes a first hook for engaging the fourth shoring beam and a second hook for engaging the center shoring beam.

* * * * *